US005711268A

United States Patent [19]

Holdampf

[11] Patent Number: 5,711,268

[45] Date of Patent: Jan. 27, 1998

[54] ROTARY VANE ENGINE

[75] Inventor: Carl J. Holdampf, Farmington Hills, Mich.

[73] Assignee: C & M Technologies, Inc., Farmington Hills, Mich.

[21] Appl. No.: 529,743

[22] Filed: Sep. 18, 1995

[51] Int. Cl.[6] ..... F02B 53/00

[52] U.S. Cl. ..... 123/243; 418/146; 418/150

[58] Field of Search ..... 123/243; 418/150, 418/146

[56] References Cited

U.S. PATENT DOCUMENTS

| | | | |
|---|---|---|---|
| 3,250,260 | 5/1966 | Heydrich . | |
| 3,762,375 | 10/1973 | Bentley . | |
| 4,106,472 | 8/1978 | Rusk | 123/243 |
| 4,202,313 | 5/1980 | Rosaen | 123/212 |
| 4,353,337 | 10/1982 | Rosaen | 123/243 |
| 4,410,305 | 10/1983 | Shank et al. | 418/150 |
| 4,414,938 | 11/1983 | Umeda | 123/229 |
| 4,422,419 | 12/1983 | Umeda | 123/235 |
| 4,521,167 | 6/1985 | Cavalleri et al. | 418/82 |
| 5,277,158 | 1/1994 | Pangman | 123/243 |
| 5,302,096 | 4/1994 | Cavalleri | 418/150 |
| 5,310,326 | 5/1994 | Gui et al. | 418/76 |

FOREIGN PATENT DOCUMENTS

| | | | |
|---|---|---|---|
| 2157450 | 5/1973 | Germany | 123/243 |
| 3335742 | 4/1985 | Germany | 123/243 |

*Primary Examiner*—Michael Koczo

*Attorney, Agent, or Firm*—Young & Basile, P.C.

[57] ABSTRACT

A rotary vane internal combustion engine wherein the section of the rotor housing where ignition takes place is formed in the shape of a circular arc matching the curvature of the rotor, with the balance of the housing periphery being composed of a series of tangent arcs to define an elliptical shape that is continuously concave and has no drastic changes in curvature. The rotor and housing are "stretched" along their axial dimensions so that each combustion chamber has an axial measurement substantially greater than its circumferential measurement, and each segment of the rotor surface between adjacent vanes has formed therein a plurality of combustion chamber pockets spaced from one another along the axial dimension of the rotor and each provided with a spark plug. Circumferentially separated and separately throttled primary and secondary intake ports are provided to reduce intake throttle losses at low engine loads, and exhaust ports are provided which extend along the axial length of the rotor housing to avoid localized heating of the vane tips. The vanes are of a novel multi-layer construction with spring loaded seals alomg their lines of contact with the stationary engine parts, thereby minimizing intra-chamber pressure leakage.

6 Claims, 6 Drawing Sheets

96
98
C
BDC2
T
B
C3
TDC2
C8
TDC1
D
94
C4
C1
A
C5
C2
C6
ROTATION
E
C7
H
BDC1
92
G
F
90

96'
E1
98'
C2
BDC2'
TDC2'
TDC1'
94'
A'
36
C1
BDC1'
92'
12
E2
14
90'

ROTARY VANE ENGINE

FIELD OF THE INVENTION

The present invention relates to a rotary internal combustion engine, and more particularly to an improved multiple vane rotary engine.

BACKGROUND

Rotary vane internal combustion engines are known to have many advantages over the more common piston-type reciprocating engine. Among these advantages are a higher power-to-weight ratio, fewer moving parts, and better dynamic balancing for smoother and quieter operation.

A rotary vane engine operates on the same four-phase Otto cycle used by a reciprocating engine, with each combustion chamber undergoing an intake phase, a compression phase, a power or work phase, and an exhaust phase. In a rotary vane engine, though, the combustion chambers are located around the circumference of a cylindrical rotor having a plurality of radial slots, in each of which a vane is mounted for sliding movement. The boundaries of each chamber are formed by: 1) a successive pair of vanes, 2) the segment of the outer surface of the rotor between those vanes, 3) the inner surface of a generally elliptical housing within which the rotor is mounted for rotation, and 4) two end plates closing off the ends of the housing cavity. The rotor has an outside diameter approximately equal to the minor axis length of the housing and is mounted at or center of the housing, and the vanes are biased outwardly from the slots in the rotor to contact the inside of the housing. Thus, as the rotor rotates to sweep each combustion chamber around the inside of the housing, the volume of each chamber changes along with the changing distance between the rotor outer surface and the housing inner surface.

When a particular combustion chamber rotates to a position where it is aligned with the minor axis of the housing, it has a minimum volume corresponding to a top-dead-center position of a piston engine; when aligned with the major axis the chamber has a maximum volume corresponding to a bottom-dead-center position. Positioning intake ports, ignition means and exhaust ports at proper locations around the housing causes the expansion and contraction of the chambers as they rotate around the housing to effect the intake, compression, power and exhaust phases of the engine cycle.

The precise shape of the housing has a large impact on engine efficiency since its interaction with the rotor determines the engine compression ratio and the rates at which the combustion chambers change volume during a revolution. U.S. Pat. No. 4,353,337 to Rosean teaches an engine having a housing composed of two semicircular arcs separated by parallel, straight segments. The arcs are of approximately the same radius as the rotor so that the points of contact between the rotor and the straight segments establish the top-dead-center positions, with the arcs bulging out to establish the bottom-dead-center positions. This design allows the rotor to be offset from the center of the housing toward the arc lying to the intake/compression side, so that the volume of a combustion chamber at bottom-dead-center at the end of the power phase is larger than at bottom-dead-center at the end of the intake phase. This asymmetry gives the engine an expansion ratio greater than its compression ratio which result in improvements in engine power and efficiency, but the straight section of the housing at the top-dead-center position where ignition occurs result in the combustion chambers having a shape that is not conducive to proper compression or flame propagation after ignition. Also, the presence of the straight sections of the housing at the top-dead-center positions results in a loss of the centrifugal force holding the vanes in contact with the inner surface of the housing as they rotate through those portions, so that the vanes may drop downward in their respective slots of they pass a vertical position.

U.S. Pat. No. 3,762,375 to Bentley teaches an engine wherein the housing sections at the top-dead-center positions have radii matching that of the rotor, and smaller radius circular arcs extending out to form the bottom-dead-center positions. As there is essentially no clearance between the housing and the rotor at top-dead-center, the only combustion chamber volume existing at full compression is that of a pocket formed in the surface of the rotor. This allows the size and shape of the combustion chamber to be tailored to achieve a high compression ratio along with a chamber shape that enhances flame propagation through the chamber.

The relationship between the curvatures at the bottom-dead-center and top-dead-center locations, though, are such that the sections of different curvature are not tangent to one another where they meet. This results in the interior of the housing having abrupt contour changes which the vanes must slide in and out to follow as they rotate with the rotor from one section to the next. The vanes must accelerate rapidly in order for them to follow the contour changes, and so they must be biased outward by gas pressure bled from the combustion chambers during the power phase.

It would be advantageous to provide a rotary vane engine having a housing shaped such that each section thereof is optimized for the phase of the cycle occurring over that section, and also shaped to provide a continuously curving surface with no abrupt discontinuities so that centrifugal force alone is sufficient to keep the vanes in sealing contact with the housing and so that the vanes are not subjected to sudden changes in centripetal acceleration.

The combustion chambers of a rotary vane engine are supplied with a combustible air/fuel charge by one or more intake ports opening onto the interior of the housing in a section where the combustion chambers are growing in volume. If a port is configured to communicate with the chamber through its entire travel through the intake section of the cycle, as it must in order for the engine to operate efficiently at high engine loads, the engine will suffer from intake charge throttling losses when it is run at low loads. It would therefor be desirable to provide a means for reducing the effective engine displacement at low engine loads in order to decrease the intake charge throttle losses and thus improve engine efficiency.

Since the motive force which drives a rotary vane engine is provided by the pressure differentials between the combustion chambers, it is necessary that effective, gas-tight seals be maintained between the vanes and the surfaces of the housing and end plates which they contact during their rotation. The centrifugal force applied to the vanes during rotation tends to hold their tips in sealing contact with the housing wall, but the high-pressure combustion gases can also leak from one combustion chamber to another along the edges of the vanes where they contact the end plates. Thermal expansion of the vanes and other engine components complicates the sealing requirement along the vane edges, since a seal requiring close dimensional tolerances may be effective at one particular engine operating temperature but be too tight or too loose at other temperatures as a result of differential expansion of parts within the engine.

In the interests of reducing the maintenance requirements of the engine, it is also important that the vane seals not wear out at an unacceptable rate. The vane tips present a particular challenge in this regard because the angle at which the vanes meets the housing wall varies continuously as the vanes rotate around the interior of the housing. It would thus be advantageous to provide rotor vane sealing means that effectively limits or prevents leakage of gases between combustion chambers over the full range of engine operating temperatures and that wears at an acceptable rate.

The vanes are subjected to an additional source of wear and undesirable heating during the exhaust phase of the engine cycle. When a combustion chamber reaches the end of the power phase, the vane constituting the leading edge of the chamber begins to sweep past and uncover one or more openings in the housing wall which serve as exhaust ports. The high-temperature pressurized gases contained by the chamber begin to escape through the ports and continue to do so as the chamber rotates through the exhaust section of the housing. During this time the exhaust gases heat the region of the vane tip adjacent the exhaust ports, and the exhaust gasses contain particles that can cause erosion of the vane surface as they blow past the tip of the vane.

U.S. Pat. No. 5,277,158 to Pangman teaches exhaust ports in the form of three slots running parallel with the circumferential dimension of the housing, while the Bentley '375 patent depicts a series of three circular exhaust ports also aligned parallel with the circumferential dimension of the housing. In both of these exhaust port configurations, only a small portion of the tip of each vane passes over an exhaust port and is thus exposed to the harmful effects of escaping combustion gases, with the result that those exposed portions will wear out more quickly that the portions not so exposed, and more quickly than if the wear were spread out over more of the vane tip. Thus, it would be advantageous to provide an exhaust port configuration that distributes the high temperatures and wear caused by escaping exhaust gases more evenly over the vane tip.

The power output of a rotary vane engine is, as with any internal combustion engine, directly related to the internal volume or displacement of the engine. To increase the displacement of a rotary vane engine, the diameter of the rotor can be increased so that more and/or larger combustion chambers can be defined about its circumference, but an increase in diameter will increase the polar moment of inertia of the rotor and vanes so that the engine can not accelerate as quickly, and also increase the centrifugal forces acting on the vanes with a consequent increase in frictional forces between the vanes and other engine components.

Another way to increase engine displacement is to mount multiple rotors on the same crank shaft. This layout results in an engine that is no larger in diameter but is longer in its axial dimension, a shape that is more practical for many engine applications. U.S. Pat. No. 5,277,158 to Pangman teaches a dual-rotor engine, with the sets of combustion chambers of each rotor separated by a central wall. This design requires twice as many vanes as a single rotor engine, and consequently a doubling of the number of precisely machined parts that must be produced and of the number of seals that must be provided, lubricated, and periodically replaced. Another problem with this design is that the central wall is exposed the heat of the combustion chambers on located on both of its sides, yet is in a position within the engine which makes it very difficult to provide a cooling fluid.

It would therefore be advantageous to provide a rotary vane engine wherein the displacement is increased with no attendant increase in engine diameter nor in the number of vanes and seals.

SUMMARY OF THE INVENTION

The present invention is directed toward a rotary vane engine having a number of improvements over prior art engines of that type. These improvements relate to the shape of the housing, the location and shape of the intake and exhaust ports, the construction of the vanes and their sealing means, and the provision of multiple combustion chambers between each pair of vanes. The improvements combine to produce a more efficient and hence more commercially viable engine for use in many different applications.

According to a feature of the invention, the section of the rotor housing where ignition takes place is formed in the shape of a circular arc matching the curvature of the rotor and the balance of the housing periphery is composed of five or more tangent circular arcs having centers of curvature and radii such as to form an elliptical shape. Alternatively, the balance of the housing may be composed of two different semi-ellipses, the first forming the expansion and exhaust sections of the housing and the second forming the intake and compression sections, with the major axis of the second semi-ellipse being longer than that of the first, and all of the sections being tangent to their adjacent sections. These composite housing geometries permit the combustion chamber volume changes that occur as each chamber moves around the housing to be optimized for the phase of the engine cycle occurring over each section of the engine, and also result in a continuously convex surface with no abrupt discontinuities so that centrifugal force alone is sufficient to keep the vanes in sealing contact with the housing surface.

According to another feature of the invention, short transition segments are interposed between the arcs making up the housing profile. The transition segments may be elliptical, spiral or any other curved, non-linear shape which results in a more gradual change in the radius of curvature of the housing in the area connecting two adjacent arcs. This more gradual change in radius reduces the rate of change of centripetal acceleration experienced by the vanes as they pass from one arc to the next, thereby providing for a better seal between the vane tips and the housing and reducing wear on the vanes.

According to a further feature of the invention, the rotor and housing are "stretched" along their axial dimensions so that each combustion chamber has an axial measurement substantially greater than its circumferential measurement. Each segment of the rotor surface between adjacent vanes has formed therein a plurality of combustion chamber pockets spaced from one another along the axial dimension of the rotor. Spark plugs equal in number to the number of combustion chamber pockets in each rotor segment are mounted at the ignition section of the housing to be in alignment with the respective combustion chamber pockets of each rotor segment when it has rotated to the ignition section. This configuration increases the displacement of each combustion chamber of the engine while resulting in no increase in the engine diameter and adding only a small number of parts to the engine. Each chamber is essentially a series of sub-chambers aligned along the axis of the rotor, with no wall separating the sub-chamber. The provision of a spark plug for each sub-chamber results in an advantageously short flame travel paths.

According to yet another feature of the present invention, the vanes are of a multi-piece construction wherein a light-weight core is surrounded by a heat and wear resistant outer sheath. The sheath wraps around the core to form the faces and the tip of the vane, and is wider than the core to form a recess running along each edge of the vane. Seals are retained in the recesses and are biased outwardly to apply pressure to the end plates as the vanes sweep around inside of the housing. The spring-biased configuration of the edge seals provides sealing contact in spite of changing clearances between the vane sheath and the end plates due to differential thermal expansion or contraction of the parts. The edge seals may also be replaced when worn without the need to replace the entire vane.

According the still another feature of the present invention, multiple exhaust ports are provided which are spaced from one another along the axial width of the housing as well as around the circumferential dimension of the housing. Staggering the ports over the width of the housing exposes a larger portion of the vane tip to the erosive effects of combustion gases escaping past the vane tip into the ports. Thus, heating and wear caused by the exhaust gases is spread out over the width of the vane to prolong the useful life of the vane. In an alternative embodiment of the invention, a single exhaust port is provided in the form of a diagonal slot in the housing. By angling across the axial width of the housing as it passes along the circumferential direction, the exhaust slot spreads the wear caused by exhausting gases out over the length of the vane.

According the still another feature of the present invention, the intake port means comprises primary intake port means communicating with the combustion chambers as they rotate through the early section of the intake phase and secondary intake port means communicating with the chamber later in the intake phase. The primary and secondary intake port means are positioned relative to one another such that each combustion chamber rotates past and is thereby closed off from the primary intake port means before reaching its full intake volume while continuing to be in communication with the secondary intake port means up until it reaches its full intake volume. Both intake port means are provided with throttle means to control the flow of the intake charge therethrough. The throttle means for each intake means are sequentially times and at light engine loads the secondary intake remains closed, thus reducing the effective engine displacement. This has the effect of reducing intake throttle losses that would otherwise occur at low engine loads if the chambers were allowed to draw air through the entire intake phase.

These and other advantages of the present invention are made clear in the detailed description to follow.

DETAILED DESCRIPTION OF THE PREFERRED EMBODIMENT

Figure 1:
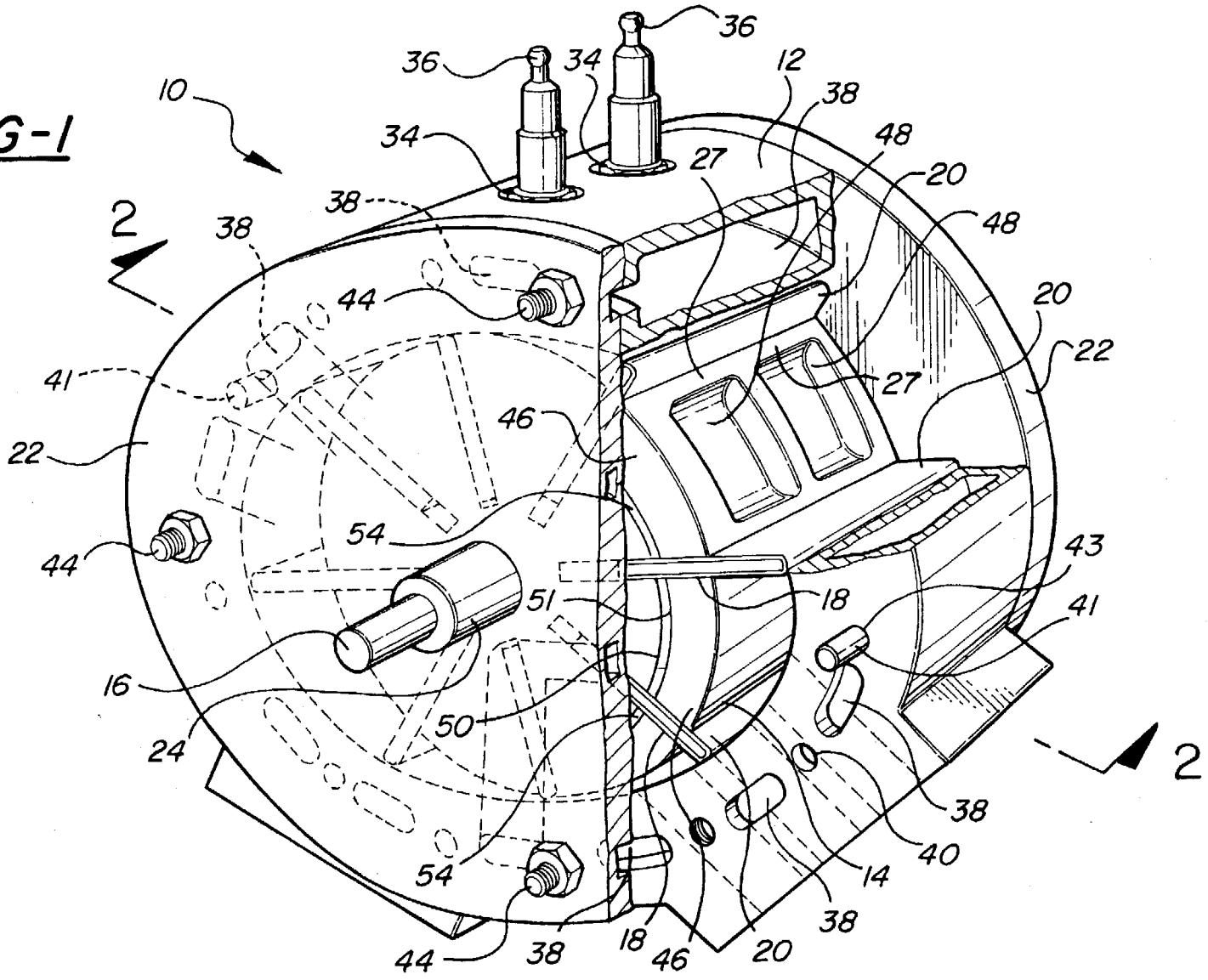
FIG. 1 is a perspective view of a rotary vane engine according to the present invention with a portion of one end plate cut away to show the engine interior.
Figure 2:
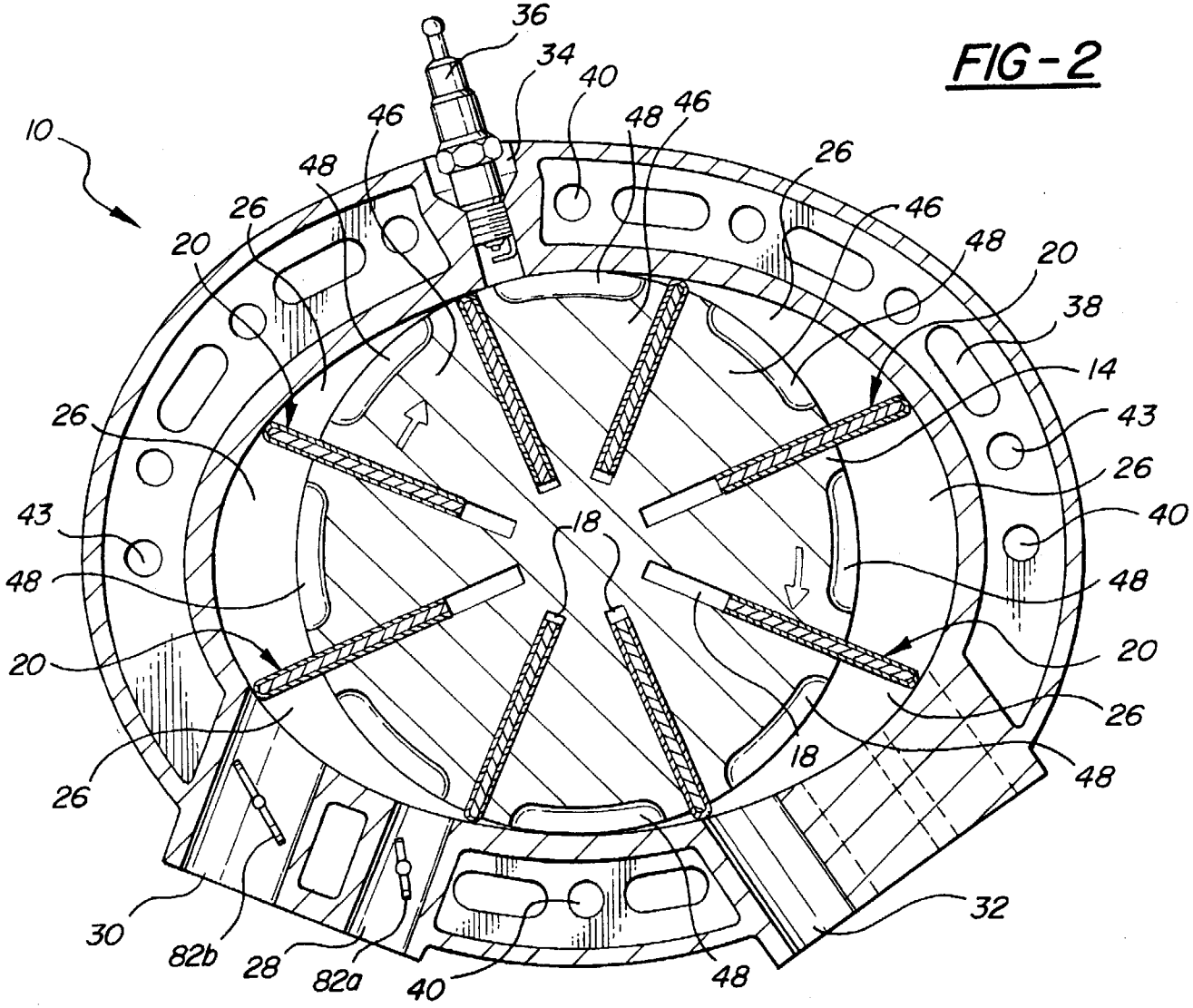
FIG. 2 is a cross sectional view taken along line 2—2 in FIG. 1.

As seen in FIGS. 1 and 2, a rotary vane engine 10 comprises a hollow, generally elliptical housing 12, a pair of end plates 22 bolted to housing 12 to close off its ends, and a rotor 14 mounted for rotation within housing 12. Rotor 14 is fixed to a shaft 16 which is supported at either end by bearings 24 attached to end plates 22. A plurality of slots 18 divide rotor 14 into pie-shaped rotor segments 46, and each slot holds a vane 20 which slides freely therein. The depicted embodiment of the invention features eight vanes 20, and so an equal number of rotor segments 46, but this is in no way a limitation on the invention.

As best seen in FIG. 2, a plurality of combustion chambers 26 are defined around the circumference of rotor 14, with the boundaries of each chamber formed by two successive vanes 20 and the surfaces of rotor segment 46, housing 12 and end plates 22 located between those vanes. As rotor 14 and vanes 20 rotate within housing 12, combustion chambers 26 move around the inside of housing 12 with their respective volumes continuously changing in accordance with the varying distance between rotor 14 and housing 12.

A plurality of bolt holes 40 pass through housing 12 in an axial direction, and end plates 22 have a corresponding set of bolt holes so that housing bolts 44 may pass therethrough and be tightened to hold end plates 22 firmly against housing 12. To provide a high level of precision in the alignment between plates 22 and housing 12, at least two dowel pins 41 pass through the housing and fit into precisely machined locating holes 43. Cooling passages 38 are formed in housing 12 and end plates 22 to permit a coolant fluid to be pumped therethrough and carry away heat generated by operation of the engine. In the described embodiment of the invention, rotor 14 and vanes 20 are cooled by the incoming charge of air used in the combustion process, but coolant passages could be provided in the rotor if necessary.

Figure 3A:
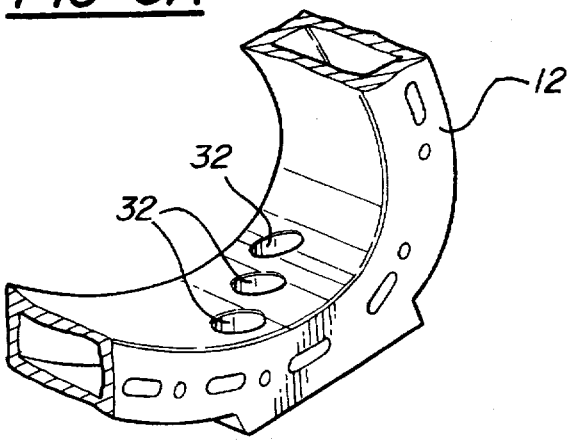
FIG. 3A is a perspective view of a portion of the housing of the invention engine showing a first embodiment of the exhaust port means.
Figure 3B:
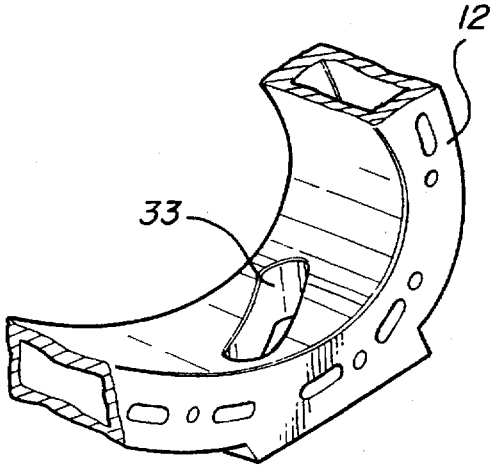
FIG. 3B is a perspective view of a portion of the housing of the invention engine showing a second embodiment of the exhaust port means.

Primary intake ports 28, secondary intake ports 30, and exhaust ports 32 penetrate housing 12 at the separate locations shown in FIG. 2. Movable throttle plates 82*a*, 82*b* are located inside of primary and secondary intake ports 28, 30 respectively. FIG. 3A depicts a preferred configuration for exhaust ports 32 wherein three separate ports are spaced across the axial width of housing 12 as well as along the circumferential direction. FIG. 3B depicts an alternative configuration wherein a single slot 33 penetrates housing 12, running diagonally across the axial dimension.

Rotor 14 and housing 12 have axial dimensions large enough in relation to the rotor diameter to provide elongated combustion chambers 26 made up of two contiguous, axially adjacent sub-chambers 27. Two chamber pockets 48 are formed in the surface of each rotor segment 46, one at the center of each sub-chamber 27. Chamber pockets 48 are somewhat elongated to extend along the circumference of rotor 14 and cover a majority of the distance between vanes 20. A pair of spark plug mounting holes 34 penetrate housing 12 and retain spark plugs 36 in positions along the axis of rotor 14 so that each communicates with a respective chamber pocket. Note that it is possible, without departing from the scope of the present invention, to construct a compression ignition engine wherein fuel injection means replaces spark plugs 36.

An annular seal groove 50 is formed in each end face of rotor 14 and contains a plurality of arcuate seal segments 54, one between each adjacent pair or vanes 20, which are biased outwardly by spring means (not shown) to contact the interior surface of end plate 22.

Figure 4:
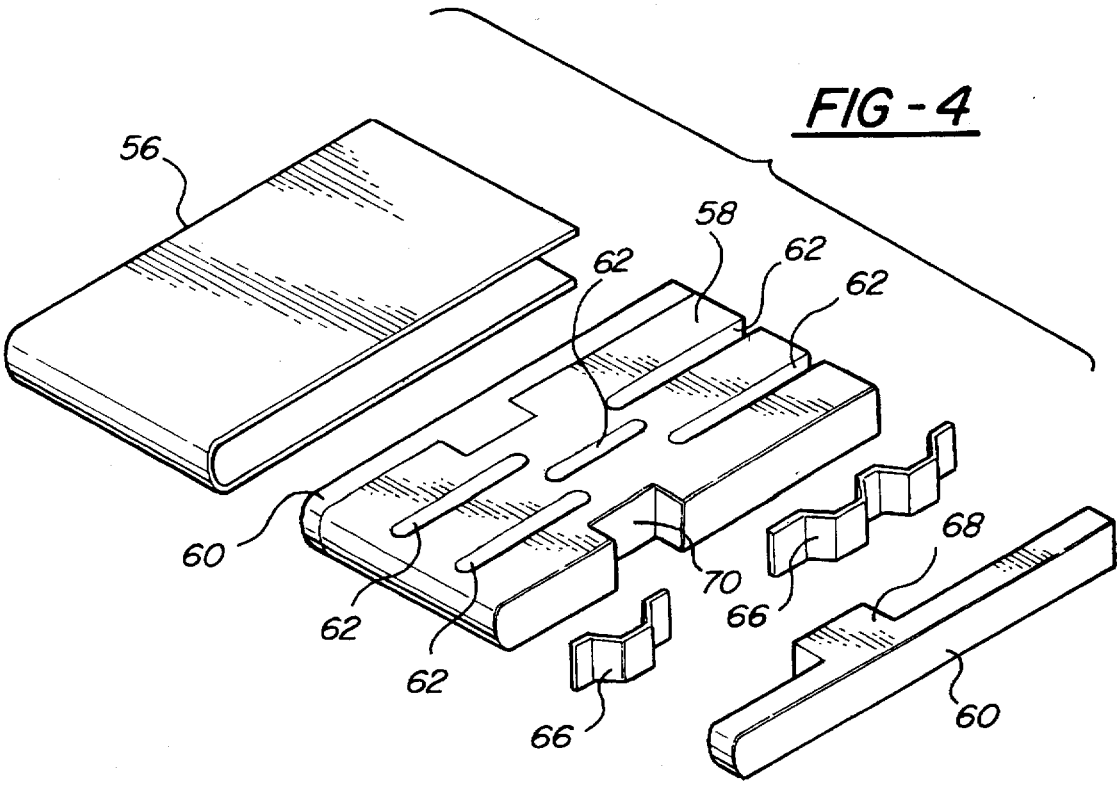
FIG. 4 is an exploded view of a first embodiment of a vane used in the invention engine.
Figure 5:
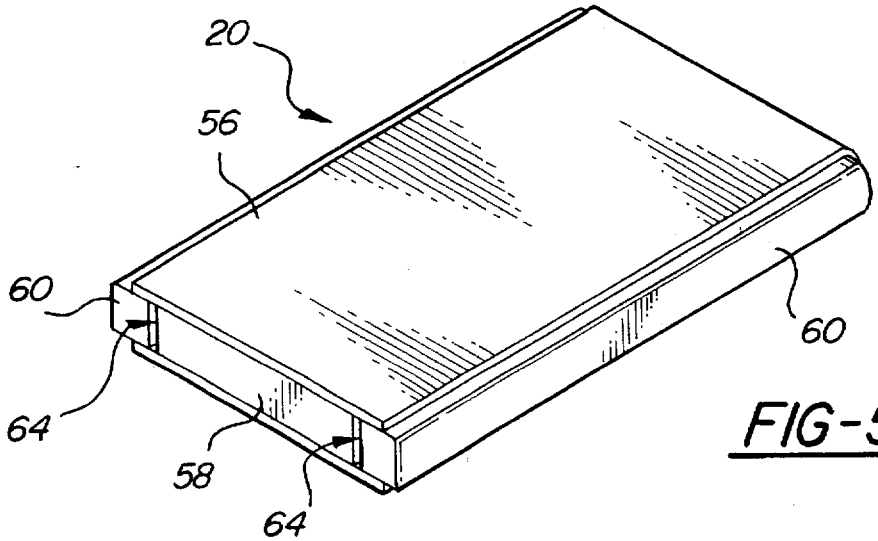
FIG. 5 is a perspective view of the vane of FIG. 4.

As shown in FIGS. 4 and 5, each vane 20 is of multiple layer construction with an outer sheath 56 wrapping around a core 58 to constitute the opposite faces and the tip of the vane. Sheath 56 is preferably formed of a metal alloy or ceramic material having a high tensile strength as well as exhibiting good resistance to high temperatures and erosive/corrosive environments. Core 58 is formed to include lightening slots 62 and is of a material of high tensile strength Core 58 is welded or otherwise fused inside of sheath 56 so that the core transmits shear loads between the opposite faces of the sheath and produce a very rigid vane. Sheath 56 is wider than core 58 so that when the two are mated an edge recess 64 is defined along either lateral edge of vane 20. An edge seal 60 is retained in each edge recess 64, and one of the seals is biased outwardly by a leaf spring 66 so that the edge seals are forced into rubbing contact with the interior surfaces of end plates 22 when vanes 20 are installed in the engine. Edge seals 60 have extensions 68 which fit into side force ramps 70 when the components are assembled to maintain the edge seals properly positioned within the vane.

Figure 6:
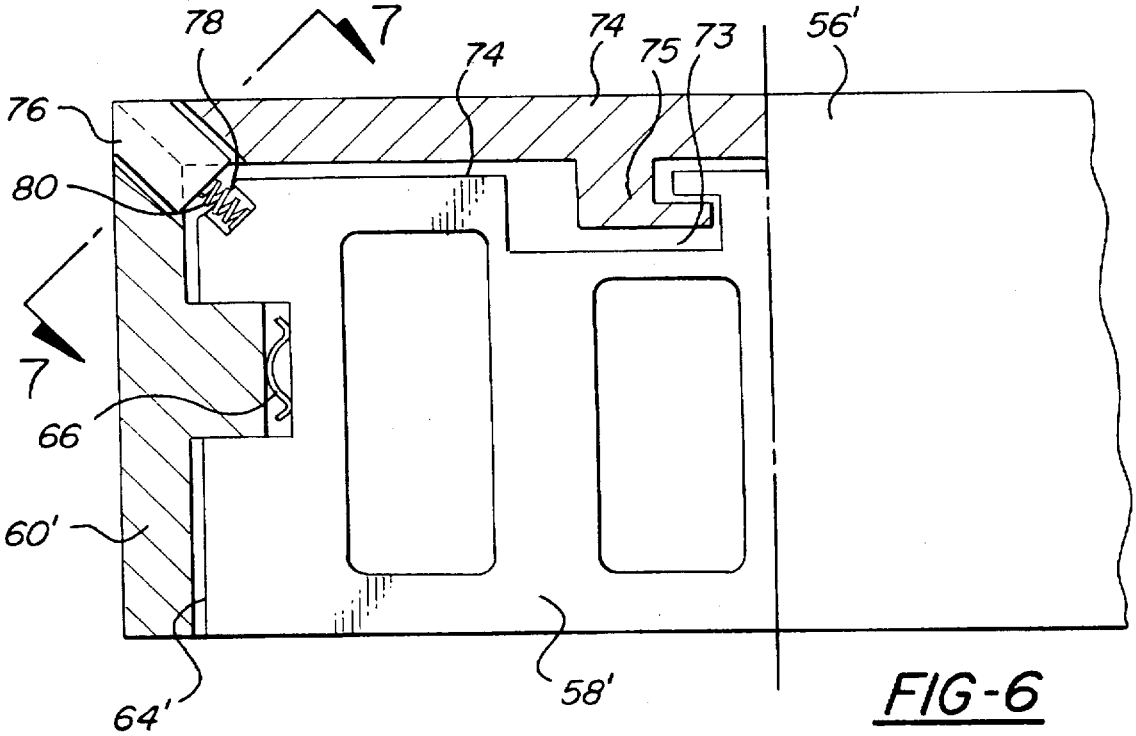
FIG. 6 is a partially cut away side view of a second embodiment of a vane used in the invention engine.
Figure 7:
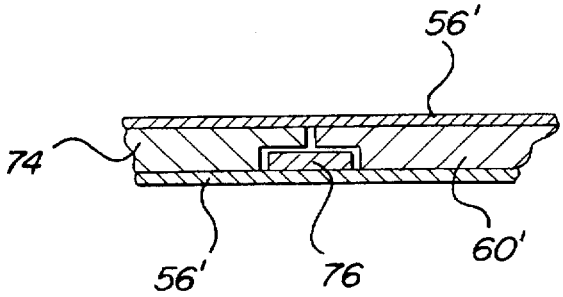
FIG. 7 is a cross section taken along line 7—7 of FIG. 6.

In an alternative construction for vanes 20, shown in FIGS. 6 and 7, the sheath is composed of two separate sheath plates 56' which overhang core 58' on three sides to define a vane having a tip recess 72 as well as lateral edge recesses 64'. Edge seals 60' fit into edge recesses 64' and are biased outwardly by springs 66' as described above, and a tip seal 74 fits into tip recess 72. Tip seal 74 has a key 75 formed on its rear edge and the key engages a retaining notch 73 cut into core 58' so that the tip seal will stay in position in tip recess 72 during the reciprocating motion of the vane. Corner seals 76 are also retained between sheath plates 56', each being spring-loaded diagonally outward toward a corner of vane 20 by a coil spring 78 or the equivalent retained in a pocket 80 formed in core 58'.

The shape of the interior surface of housing 12 is made up of a series of tangent circular arcs forming a continuously concave surface having no abrupt changes in curvature. The resulting generally elliptical shape may be divided into several discrete sections based on the functional phases of the engine cycle. As shown schematically in FIG. 8, housing 12 comprises an intake section 90 extending from a first top-dead-center position TDC1 located on the minor axis of the housing through a first bottom-dead-center position BDC1 on the major axis, a compression section 92 extending from BDC1 through the location of spark plug 36, an ignition section 94 extending from spark plug 36 through a second top-dead-center position TDC2, a power section 96 extending from TDC2 through a second bottom-dead-center position BDC2, and an exhaust section 98 extending from BDC2 through TDC1.

Ignition section 94 is defined by an arc A having a radius only slightly greater than that of rotor 14 and with its center of curvature located at C1, coincident with the rotor axis. Arc B has a center of curvature located at C2 and extends from the end of arc A to part way through power section 96. Arc C has a center at C3 and adjoins arc B, extending through BDC2 and into exhaust section 98. Arc D is centered at C4 and forms the remainder of exhaust section 98, terminating at the TDC1 position. Arc E has a center of curvature located at C5 and extends from TDC1 to a point in intake section 90 between primary intake ports 28 and secondary intake ports 30 Arc F is centered at C6 and completes intake section 90, terminating at BDC1. Arc G and arc H are centered at points C7 and C8 respectively and form compression section 92, with arc H adjoining arc A.

Figure 8:
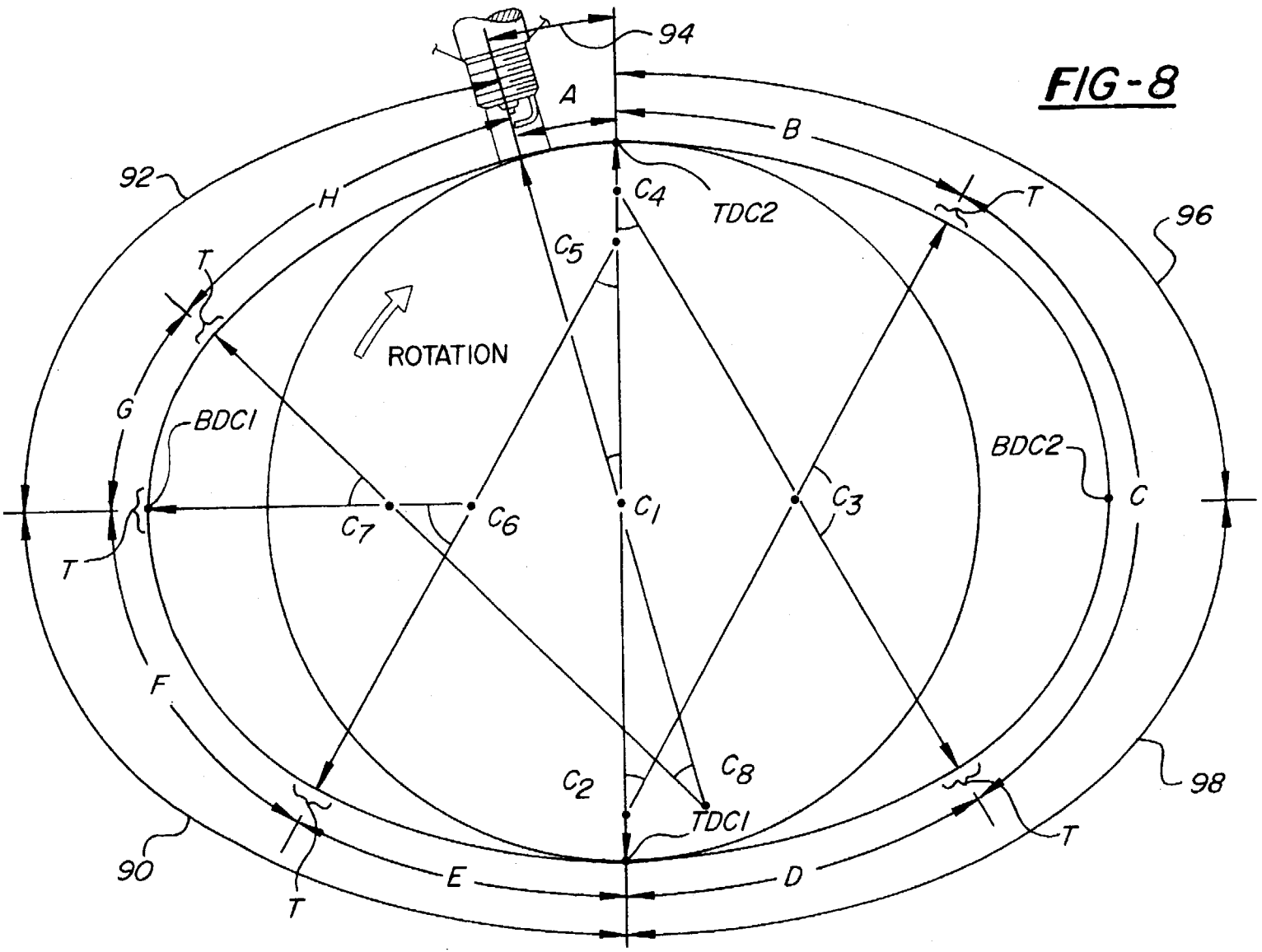
FIG. 8 is a schematic depiction of the geometry of a rotor housing according to a first embodiment of the invention engine.

Note that the locations of the centers of curvature C1–C8 shown in FIG. 8 results in all of the arcs being tangent at their end points so that vanes 20 are not subjected to sudden changes in centripetal acceleration as they transition from one arc to the next during rotation of rotor 14. Such acceleration changes can cause the vanes to lose sealing contact with the housing surface or to be subjected to increased frictional forces and so wear more quickly. If necessary in order to further reduce the rate of change in centripetal acceleration experienced by the vanes during rotation, the arcs may be connected by short transition segments T in the form of tangent ellipses, spirals or some other curved, non-linear shape providing a more gradual change in radius between adjacent arcs.

Note that the power/exhaust side of housing 12 (the right-hand side in FIG. 8) is symmetric about the major axis; that is, arc B and arc D have the same radius and are the same length and arc C is centered about the major axis. In the preferred embodiment, however, the intake/compression or left-hand side of housing 12 is not symmetric about the major axis because of the placement of arc A to form ignition section 94.

In the preferred embodiment, the radii of arcs A–H and the placements of centers C1–C8 are such that the distance between the rotor center of rotation and the housing surface is greater at the BDC2 position than at the BDC1 position. This results in the volume of a combustion chamber being greater when it is aligned with BDC2 than when aligned with BDC1, with consequent benefits to engine operating efficiency as described in the "Engine Operation" section below.

Figure 9:
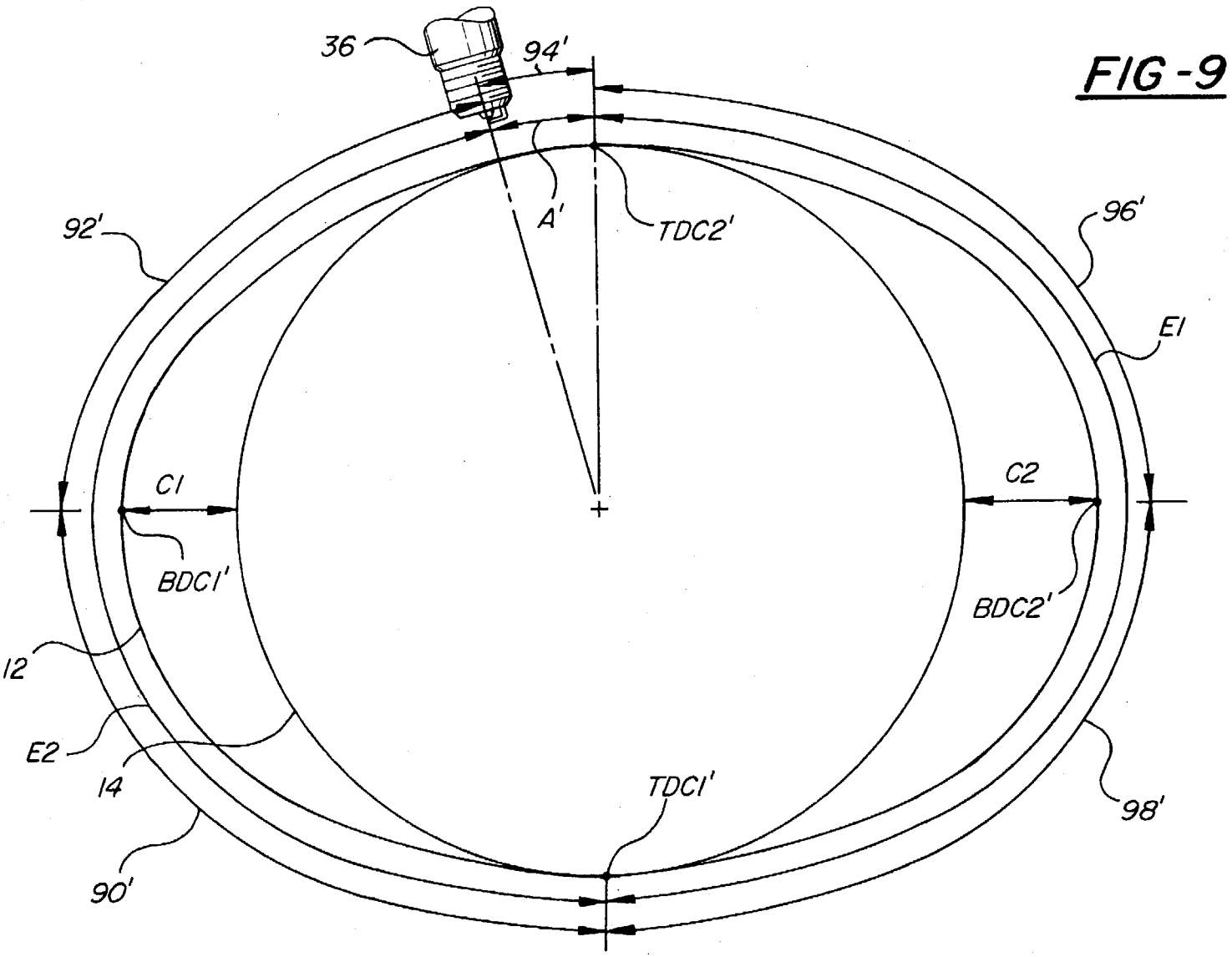
FIG. 9 is a schematic depiction of the geometry of a rotor housing according to a second embodiment of the invention engine.

In an alternative embodiment of a housing according to the present invention, as shown in FIG. 9, ignition section 94' is composed of an arc A' substantially matching the curvature of rotor 14 as in the above-described embodiment but the balance of the housing is composed of two different semi-ellipses. Semi-ellipse E1 is tangent to arc A' at TDC2' and extends clockwise through TDC1' to form power section 96' and exhaust section 98'. Semi-ellipse E2 forms intake section 90' and compression section 92' and is tangent to arc A' and semi-ellipse E1. The major axis length of semi-ellipse E1 is greater than that of semi-ellipse E2 so that, as in the first described embodiment of the housing, the volume of a combustion chamber is greater when aligned with BDC2' than when aligned with BDC1'.

Engine Operation

As viewed in FIG. 2, rotor 14 rotates in a clockwise direction during engine operation with each combustion chamber 26 completing a full power-producing cycle during a single revolution of the rotor. As a combustion chamber sweeps through intake section 90, it continually increases in volume thereby creating a vacuum condition and drawing an intake charge (a combustible mixture of air and atomized fuel) supplied from a conventional carburetor or fuel injection system (not shown) inward through primary and secondary intake ports 28,30. Note that because of the angular separation between the primary intake ports and the secondary intake ports, the vane constituting the rearmost end of a chamber rotates past the primary ports before the chamber has reached BDC2, its full volume position. Once this has occurred the primary ports are closed off from the chamber and it can only continue to draw the intake charge through the secondary ports. Opening and closing movements of primary and secondary throttle plates **82*a*, 82*b* are phased so that the primary throttle plates open first followed by the secondary plates, with such phasing arranged to provide smooth throttle response while reducing the intake gas throttling losses. At high engine power settings, secondary ports 30 remain open so that they continue to supply the intake charge until the chamber reaches its full volume. At lower power settings, though, throttle plates 82b** close off the chamber so that no additional intake charge is supplied through the secondary ports. This has the effect of decreasing the effective engine displacement and thereby reducing intake charge throttle losses that otherwise occur when a large displacement engine is operated at low loads.

Combustion chamber 26 is closed off from secondary intake ports 30 as it reaches its full volume at BDC1, and the volume then decreases as it rotates through compression section 92. Upon reaching ignition section 94, where the clearance between the surfaces of rotor 14 and housing 12 is effectively zero, the volume of chamber 26 is reduced to that of the two chamber pockets 48 between the vanes. Compression of the intake charge entirely into the chamber pockets causes considerable turbulence within the charge and hence enhances mixing of the atomized fuel with the air. This mixing is desirable because it leads to more complete and uniform combustion of the air/fuel mixture.

As the combustion chamber reaches full compression at the TDC2 position, spark plugs 36 are fired by a conventionally known ignition system. Chamber pockets 48 are preferably elongated in shape to cover as much of the circumferential distance between the vanes as possible so that spark timing may be varied, as is possible with a conventionally known electronic ignition system, over the widest possible range depending on engine operating conditions.

Once the subject combustion chamber 26 has rotated marginally past ignition section 94, the burning fuel/air charge is no longer contained only in chamber pockets 48, but expands out into the rest of the volume between vanes 20. This expansion and burning progresses from each chamber pocket 48 into its respective sub-chamber 27. Sub-chambers 27 have a nearly square shape when viewed along a radial line looking inward toward the center of rotor 14, and this square shape provides for an advantageously short flame propagation path through the fuel/air charge of each sub-chamber.

Combustion occurs within the chamber as it rotates through power section 96, with the pressure of the expanding combustion gases acting on the surface of the leading vane to apply a motive force to rotor 14.

As the subject combustion chamber achieves full expansion at the BDC2 position, the forwardmost vane reaches the first of exhaust ports 32. After this position, rotation of the chamber through exhaust section 98 causes it to decrease in volume and so forces the products of combustion out through exhaust ports 32. The staggering of exhaust ports 32 across the axial width of housing 12, as shown in FIG. 3A, serves to expose a large portion of the width of the tip of each vane 20 to the escaping exhaust gases so that the heat and wear caused thereby is distributed over a large area of the vane. In an alternative embodiment of the exhaust ports shown in FIG. 3B, a diagonally oriented slot 33 likewise serves to spread the exposure to the escaping exhaust gases over a large portion of the vane tips and so lengthen the life of the vanes.

During engine operation, pressure differentials between combustion chambers at different points in the cycle tend to equalize by leakage around the vane edges where they contact housing 12 and end plates 22. Such leakage reduces engine efficiency and must be minimized. Leakage at the interface between the vane edges and end plates 22 is minimized by edge seals 60, which are retained in edge recesses 64 and biased into sealing contact with the end plates by leaf spring 66. The spring-biasing of edge seals 60 provides sealing contact in spite of changing clearances between vane sheath 56 and end plates 22 due to differential thermal expansion or contraction of the parts.

Leakage of pressure from a combustion chamber may also occur in an inward radial direction between rotor 14 and end plate 22, around the inner end of the vane, and then outwardly again into another chamber. This leakage is minimized by seal segments 54 carried by rotor 14 in seal grooves 50. Note that to be effective, seal grooves 50 must be positioned far enough radially outward on rotor 14 that even when vanes 20 are fully extended at the bottom-dead-center positions the vanes are not completely outside of seal grooves 50.

Seal grooves 50 should be located close to the outside diameter of rotor 14 for the additional reason of minimizing the amount of exhaust emission of unburned hydrocarbons. A small amount of the intake charge gases will intrude into the space between the rotor side walls and end plate 22, and combustion will not propagate into this region. The gases thus remain unburned and may be expelled from the engine during the exhaust phase. The farther outboard the seal grooves, the less volume is available to contain unburned fuel. Seal segments 54 are spring biased in the same manner as the vane edge seals 60 in order to seal effectively in spite of differential thermal expansion causing changes in the clearance between rotor 14 and end plates 22.

The tip of vane 20 as constituted by the rounded end of sheath 56 is subjected to constant wearing contact with the inside of housing 12. This wear can lead to rapid degradation of the vane, particularly if it is concentrated on a single line of contact running along the width of the vane. To avoid such a wear concentration, the tip of sheath 56 is formed with a circular radius that is large with respect to the thickness of the vane. As the vanes rotate around housing 20 the angle at which they meet the housing surface changes, varying from perpendicular when they are aligned with the major and minor axes to approximately 60 degrees at the midpoints between those axes. The blunt end of vane 20 combines with this changing angle to cause the line of contact between the vane and the housing to shift around over a broad portion of the circumference of the tip, so that wear is spread out over a large area.

Whereas a preferred embodiment of the invention has been illustrated and described in detail, it will be apparent that various changes may be made in the disclosed embodiment without departing from the scope or spirit of the invention.

I claim:

1. A rotary vane internal combustion engine wherein a cylindrical rotor having a plurality of radial guide slots slidingly retaining a plurality of vanes is rotatably mounted inside of a generally elliptical housing having intake means, ignition means, and exhaust means, characterized in that:

the housing has an internal surface comprising a series of tangent arcs and at least one non-linear transition segment interposed between at least two of the tangent arcs, the at least one transition segment providing a more gradual change in radius of curvature between the at least two tangent arcs and the internal surface being concave at every point on the surface.

2. A rotary vane internal combustion engine according to claim 1 wherein the transition segment is a spiral.

3. A rotary vane internal combustion engine according to claim 2 wherein the volume of a chamber located at a bottom-dead-center power position is greater than the volume of a chamber located at a bottom dead center intake position.

4. A rotary vane internal combustion engine according to claim 2 wherein the transition segment is an elliptical arc.

5. A rotary vane internal combustion engine wherein a cylindrical rotor having a plurality of radial guide slots slidingly retaining a plurality of vanes is rotatably mounted inside of a generally elliptical housing having intake means, ignition means, and exhaust means, characterized in that:

the housing has a profile comprising a series of at least six tangent circular arcs, no two adjacent circular arcs having the same radius and center of curvature.

6. A rotary vane internal combustion engine wherein a cylindrical rotor having a plurality of radial guide slots slidingly retaining a plurality of vanes is rotatably mounted inside of a generally elliptical housing to define a plurality of combustion chambers around the periphery of the rotor, and having intake means, ignition means, and exhaust means which interact to produce a thermodynamic cycle causing the rotor to be driven in rotation, characterized in that:

the housing has a profile comprising a series of at least six tangent arcs defining an internal surface which is concave at every point on the surface, one of the arcs being a circular arc which is concentric to the rotor axis of rotation and has a radius providing minimum operating clearance to the rotor, said one of the arcs defining a location of maximum compression, and the ignition means is located adjacent said location of maximum compression;

the intake means comprises primary intake port means for supplying air and fuel to each combustion chamber during a first portion of the intake phase and secondary intake port means for supplying air and fuel to each combustion chamber during a second portion of the intake phase, the primary and secondary intake port means being positioned relative to one another such that each combustion chamber rotates past and is thereby closed off from the primary intake port means before reaching its full intake volume while continuing in communication with the secondary intake port means through reaching its full intake volume, the primary and secondary intake port means have respective primary and secondary throttle means controlling fluid flow therethrough, and the secondary throttle means controllable to cut off the supply of air and fuel to each combustion chamber during the second portion of the intake phase during a low engine load condition; and the exhaust means comprises a plurality of exhaust ports formed in the housing to communicate with the interior thereof, the exhaust ports being offset from one another over the axial dimension and over the circumferential dimension of the housing.

* * * * *